US005226735A

United States Patent [19]

Beliveau

[11] Patent Number: 5,226,735

[45] Date of Patent: Jul. 13, 1993

[54] PERFORATED PLASTIC BAG FOR PACKAGING FRUITS OR VEGETABLES

[76] Inventor: Daniel Beliveau, 73 rue Masson, St-Roch de l'Achigan, Quebec, Canada

[21] Appl. No.: 936,575

[22] Filed: Aug. 27, 1992

[30] Foreign Application Priority Data

Aug. 28, 1991 [CA] Canada ..... 2050145

[51] Int. Cl.[5] ..... B65D 33/01; B65D 33/04

[52] U.S. Cl. ..... 383/103; 383/106; 383/107

[58] Field of Search ..... 383/66, 100, 101, 102, 383/103, 106, 117, 107; 206/439

[56] References Cited

U.S. PATENT DOCUMENTS

| | | | |
|---|---|---|---|
| 2,619,277 | 11/1952 | Shumann . | |
| 2,689,678 | 9/1954 | Wendt . | |
| 2,745,593 | 5/1956 | Brady . | |
| 2,774,402 | 12/1956 | Wikle | 383/102 |
| 3,123,279 | 3/1964 | Day | 383/117 X |
| 3,147,789 | 9/1964 | Paulson | 383/106 X |
| 3,229,813 | 1/1966 | Crowe, Jr. et al. . | |
| 3,245,606 | 4/1966 | Crane . | |
| 3,474,952 | 10/1969 | Cover, Jr. et al. | 383/117 X |
| 3,554,368 | 1/1971 | Nagel | 383/117 X |
| 3,719,736 | 3/1973 | Woodruff | 383/103 X |
| 3,839,525 | 10/1974 | Doll | 383/117 X |
| 4,911,872 | 3/1990 | Hureau et al. | 383/103 X |

FOREIGN PATENT DOCUMENTS

| | | | |
|---|---|---|---|
| 0202433 | 3/1959 | Fed. Rep. of Germany | 383/106 |
| 2802849 | 7/1978 | Fed. Rep. of Germany | 383/103 |
| 2807162 | 8/1978 | Fed. Rep. of Germany . | |
| 921016 | 1/1947 | France . | |
| 7801075 | 9/1978 | Netherlands . | |
| 647209 | 1/1985 | Switzerland . | |
| 2141688 | 1/1985 | United Kingdom | 383/100 |

*Primary Examiner*—Allan N. Shoap
*Assistant Examiner*—Jes F. Pascua
*Attorney, Agent, or Firm*—Merchant, Gould, Smith, Edell, Welter & Schmidt

[57] ABSTRACT

A bag, for packaging fruits or vegetables, is made of opaque, flexible plastic sheet material. The rear wall of the bag is however provided with a tranversal window made of transparent, flexible plastic sheet material, extending over the width of the bag and comprising a plurality of perforations distributed over its surface. The transparent plastic sheet material is thicker than the opaque plastic sheet material; it requires additional mechanical resistance due to the perforations. A method and apparatus fabricate the plastic bag from two strips of opaque plastic sheet material, and a strip of transparent plastic sheet material. In accordance with this method, the three strips are placed side by side with the transparent strip in the center; the adjacent borders of the strips are heat welded together to convert the three strips to a single band; this band is folded to form a two-layer band; and this two-layer band is tranversely cut at longitudinally spaced apart locations thereof with the two layers heat welded on both sides of each cut.

6 Claims, 2 Drawing Sheets

PERFORATED PLASTIC BAG FOR PACKAGING FRUITS OR VEGETABLES

BACKGROUND OF THE INVENTION

1. Field of the Invention

The present invention relates to a bag for packaging fruits or vegetables. The bag of the invention is made of opaque plastic sheet material but comprises on its rear wall a transversal perforated window made of transparent plastic sheet material. The present invention also extends to a method and apparatus for fabricating the plastic bag.

2. Brief Description of the Prior Art

Paper bags with perforated windows, such as that illustrated in FIG. 5 of U.S. Pat. No. 2,745,593 granted to C. V. Brady on May 15, 1956, are currently used for packaging potatoes. They present the drawback of absorbing too much humidity over a long period of storage, and accordingly of causing shrinking of the skin of the potatoes. High costs are also involved in their fabrication.

Examples of transparent and perforated plastic bags for packaging fruits or vegetables are disclosed in U.S. Pat. No. 2,689,678 (Wendt) issued on Sep. 21, 1954, U.S. Pat. No. 3,245,606 (Crane) granted on Apr. 12, 1966, and in the patent document NL 197809.

A first drawback of the transparent plastic bags is that they expose the fruits or vegetables to light. In the case of potatoes, such exposure to light causes appearance of health hazardous green regions.

The end slits of the bag of U.S. Pat. No. 2,689,678 will underventilate the fruits or vegetables. Concerning the plastic bag of U.S. Pat. No. 3,245,606, the high concentration of slits in a delimited zone will overventilate the fruits or vegetables and will greatly reduce the mechanical resistance of the bag in this zone.

Patent document NL 197809 discloses a bag comprising perforations distributed over its entire surface. When bags as disclosed in this document are filled with fruits or vegetables and are stacked upon storage, up to 40% of the perforations are closed by the fruits or vegetables, and/or by the surrounding plastic bags. Proper ventilation of the fruits or vegetables is thereby prevented.

OBJECT OF THE INVENTION

The principal object of the present invention is therefore to eliminate the above discussed drawbacks of the prior art.

SUMMARY OF THE INVENTION

More specifically, in accordance with the present invention, there is provided a bag for packaging fruits or vegetables, made of substantially opaque, flexible plastic sheet material. At least one of the front and rear walls of the bag is formed with a transversal window made of transparent, flexible plastic sheet material, this transversal window extending over the width of the bag and comprising perforations distributed over its surface. The transparent plastic sheet material has a higher mechanical resistance than the opaque plastic sheet material.

The bag of the present invention has, amongst others, the following advantages: (a) the substantially opaque plastic sheet material protects the fruits or vegetables against exposure to light, (b) the transparent window allows the consumers to visually inspect the fruits or vegetables, and (c) as the mechanical resistance of the plastic sheet material of the window is higher, the perforations do not affect the mechanical integrity of the plastic bag.

Also, as the perforations are distributed over the surface of the transparent window itself extending over the width of the bag, only a few (about 10%) of the perforations can be closed by the fruits or vegetable and/or by the surrounding bags of the stack. This is a substantial reduction in comparison with the conventional plastic bags of which up to 40% of the perforations can be closed.

In accordance with preferred embodiments of the bag according to the invention, (a) the transparent plastic sheet material is thicker than the substantially opaque plastic sheet material, (b) the transversal window is rectangular and made of a strip of the transparent plastic sheet material heat welded to the substantially opaque plastic sheet material, and (c) the perforations in the window are circular.

The present invention also relates to a method of fabricating plastic bags as described above from (a) a first strip of substantially opaque, flexible plastic sheet material comprising a first longitudinal border, and (b) a second strip of transparent, flexible plastic sheet material having a second longitudinal border, comprising the steps of:

placing the first and second strips side by side with the first and second longitudinal borders adjacent to each other;

joining the first and second adjacent borders together to convert the first and second strips to a single band of plastic sheet material;

folding the single band lengthwise to form a band comprising two layers of plastic sheet material; and transversely cutting the two-layer band at longitudinally spaced apart locations thereof while joining together the two layers on both sides of each cut, whereby each pair of consecutive cuts produces a plastic bag comprising open and closed ends, and a transversal window constituted by the second strip.

The present invention is also concerned with a method of fabricating the plastic bags from (a) a first strip of substantially opaque, flexible plastic sheet material comprising a first longitudinal border, (b) a second strip of transparent, flexible plastic sheet material having second and third opposite longitudinal borders, and (c) a third strip of substantially opaque, flexible plastic sheet material having a fourth longitudinal border, comprising the steps of:

placing the first and second strips side by side with the first and second longitudinal borders adjacent to each other, and placing the second and third strips side by side with the third and fourth longitudinal borders adjacent to each other;

joining the first and second adjacent borders together and joining the third and fourth adjacent borders together, to convert the first, second and third strips to a single band of plastic sheet material;

folding this single band lengthwise to form a band comprising two layers of plastic sheet material; and transversely cutting this two-layer band at longitudinally spaced apart locations thereof while joining together the two layers on both sides of each cut, whereby each pair of consecutive cuts produces a plastic bag comprising open and closed ends, and a transversal window constituted by the second strip.

In accordance with preferred embodiments, (a) the step of joining the first and second borders comprises heat welding these first and second borders, and the step of joining the third and fourth borders comprises heat welding these third and fourth borders, (b) the method further comprises the step of perforating the second strip to provide it with perforations distributed over the entire surface of the transparent plastic sheet material, and (c) the step of transversely cutting the two-layer band comprises heat welding the two layers of this band on each side of the cut.

The present invention further relates to an apparatus for fabricating plastic bags from (a) a first strip of substantially opaque, flexible plastic sheet material comprising a first longitudinal border, and (b) a second strip of transparent, flexible plastic sheet material having a second longitudinal border, comprising:

means for placing the first and second strips side by side with the first and second longitudinal borders adjacent to each other;

means for joining the first and second adjacent borders together to convert the first and second strips to a single band of plastic sheet material;

means for folding the single band lengthwise to form a band comprising two layers of plastic sheet material; and means for transversely cutting the two-layer band at longitudinally spaced apart locations thereof while joining together the two layers on both sides of each cut, whereby each pair of consecutive cuts produces a plastic bag comprising open and closed ends, and a transversal window constituted by the second strip.

The invention still further relates to an apparatus for fabricating plastic bags from (a) a first strip of substantially opaque, flexible plastic sheet material comprising a first longitudinal border, (b) a second strip of transparent, flexible plastic sheet material having second and third opposite longitudinal borders, and (c) a third strip of substantially opaque, flexible plastic sheet material having a fourth longitudinal border, comprising:

means for placing the first and second strips side by side with the first and second longitudinal borders adjacent to each other, and means for placing the second and third strips side by side with the third and fourth longitudinal borders adjacent to each other;

means for joining the first and second adjacent borders together and means for joining the third and fourth adjacent borders together, to convert the first, second and third strips to a single band of plastic sheet material;

means for folding the single band lengthwise to form a band comprising two layers of plastic sheet material; and means for transversely cutting the two-layer band at longitudinally spaced apart locations thereof while joining together the two layers of this strip on both sides of each cut, whereby each pair of consecutive cuts produces a plastic bag comprising open and closed ends, and a transversal window constituted by the second strip.

As can be appreciated, the method and apparatus of the invention can be used to fabricate plastic bags having a transparent window which is not perforated. Such bags can eventually be useful for purposes other than packaging fruits or vegetables.

An advantage of the method and apparatus in accordance with the present invention is that a strip of transparent plastic sheet material thicker than the layer(s) of substantially opaque plastic sheet material can be used to produce the perforated transparent window of the bags. The mechanical integrity of the bags can thereby be preserved, as discussed in the foregoing description.

The objects, advantages and other features of the present invention will become more apparent upon reading of the following non restrictive description of preferred embodiments thereof, given by way of example only with reference to the accompanying drawings.

DETAILED DESCRIPTION OF THE PREFERRED EMBODIMENTS

Figure 1:
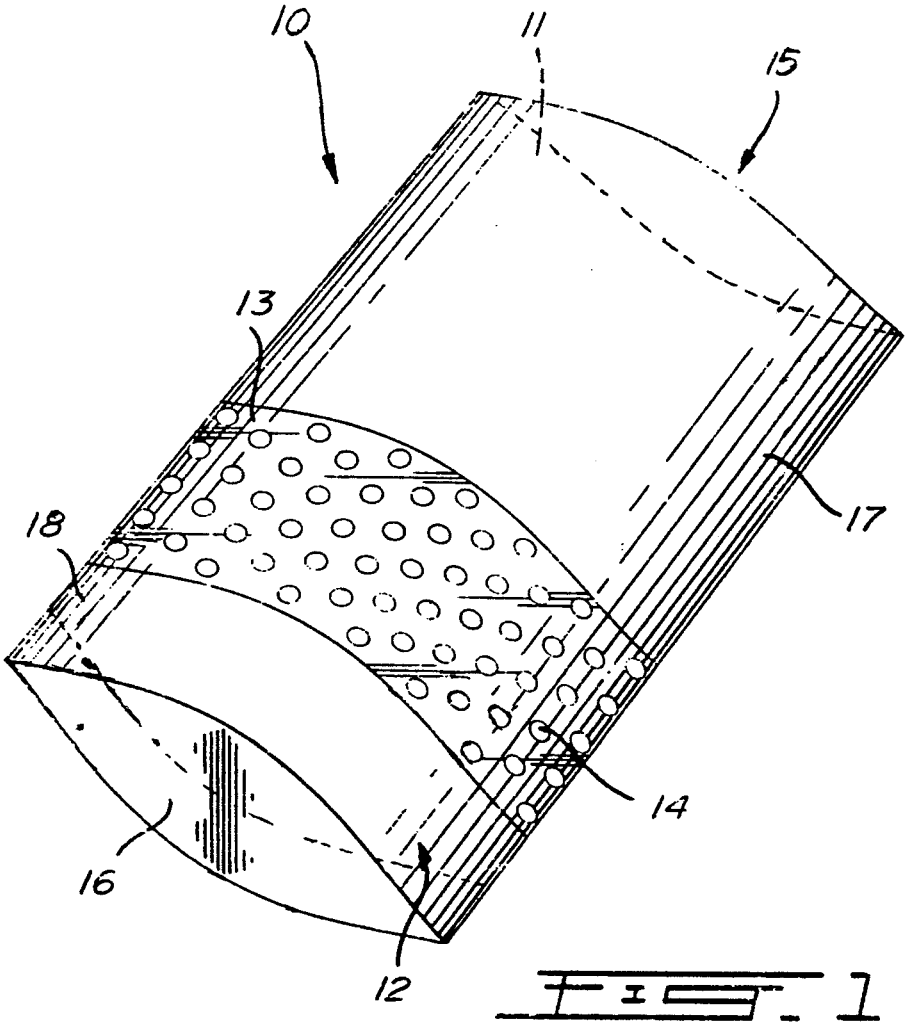
FIG. 1 is a rear, perspective view of a plastic bag in accordance with the present invention.

The plastic bag in accordance with the present invention is generally identified by the reference numeral 10 in FIG. 1.

The bag 10 includes a front wall 11 made of opaque, flexible plastic sheet material, and a rear wall 12 also made of opaque, flexible plastic sheet material but comprising a transparent window 13. More specifically, the rear wall 12 comprises two opaque wall portions 17 and 18 separated by the transparent window 13.

According to governmental regulations, bags containing fruits or vegetables must comprise a transparent window enabling the consumers to visually inspect the product. The bag 10, comprising the transparent window 13, increases by 20 to 30% the visibility of the fruits or vegetables.

As can be seen in FIG. 1, the window 13 is rectangular and is made of transparent, flexible plastic sheet material. The window 13 extends over the width of the bag 10 and includes a plurality of circular perforations such as 14 distributed over the entire surface of the window 13.

The plastic bag comprises an open end 15 and a closed end 16, this closed end being of the two-fold type (see FIG. 2), as will be explained in detail in the following description. After the bag 10 has been filled with fruits or vegetables, its open end 15 can of course be closed and/or sealed in accordance with conventional techniques. For example, the front 11 and rear 12 walls can be heat welded together to seal the end 15.

The number and dimensions of the perforations 14 are selected to appropriately ventilate the fruits or vegetables without drying them out.

As the perforations 14 are distributed over the entire surface of the transparent window 13 itself extending over the width of the bag 10, only a few (about 10%) of the perforations can be closed by the fruits or vegetables, for example potatoes, and by the other surrounding bags of a stack of such bags. The interior of the bag 10 is therefore continuously ventilated.

The plastic sheet material of the window 13 is thicker to prevent the perforations 14 to affect the mechanical integrity of the bag 10. As the perforations 14 are concentrated in the window 13, they do not affect the mechanical resistance of the other portions of the bag 10 which do not need to be reinforced. This is susceptible to reduce the cost of the bag 10.

When the bags are stacked and/or positioned with the window 13 underneath, the opaque plastic material of the bag 10 protects the fruits or vegetables against exposure to light.

A method and an apparatus for fabricating plastic bags 10 according to the present invention will now be described with reference to FIG. 3.

In accordance with the method of the invention, the bags 10 are fabricated from (a) a strip 30 of opaque polyethylene sheet wound onto a roller 31 and having a thickness of 0.0015 inch, (b) a strip 32 of transparent polyethylene sheet wound onto a roller 33 and having a thickness of 0.0045 inch, and (c) a strip 34 of opaque polyethylene sheet wound on a roller 35 and having a thickness of 0.0015.

As the transparent strip 32 is thicker than the strips 30 and 34, the perforations 14 (FIG. 1) do not affect the mechanical integrity of the bags 10 since the strip 32 is of greater mechanical resistance.

In a first step 40, the strip 30 is unwound from the roller 31 and passed through a printing machine 36 and wound again onto a roller 37. The machine 36, of known and conventional design, prints on the strip 30 all the information that should appear onto the outside face of the front wall 11 (FIG. 1).

A second step 50 consists of unwinding the strips 30, 32 and 34 from the rollers 37, 33 and 35, respectively, and of placing these three strips side by side with their adjacent longitudinal borders overlapping each other.

More specifically, the strips 30 and 32 are placed side by side with the adjacent longitudinal border of the strip 30 overlapping the longitudinal border of the strip 32. In the same manner, the strips 32 and 34 are placed side by side with the adjacent longitudinal border of the strip 34 overlapping the longitudinal border of the strip 32. The width of the overlaps 38 and 39 is of about 0.5 inch.

To place the strips 30, 32 and 34 side by side, a pair of pressing rollers 41 and 42 can be used. As illustrated in FIG. 3, the strips 30, 32 and 34 are unwound from the rollers 37, 33 and 35 and passed between the rollers 41 and 42. It is of course important that the same tension be applied to the three strips 30, 32 and 34. This is carried out by associating to each roller 33, 35 and 37, a system (not shown) which detects the varying diameter of the associated roller to produce an adequate resistance of this roller to rotation. This type of system is well known in the art and will not be further described.

The step 50 further comprises heat welding together the borders at the overlaps 38 and 39 to form a single band 43 of polyethylene sheet. This is carried out by turning the three strips onto a further roller 44 and by heat welding the overlaps 38 and 39 through a pair of semicircular slits 45 and 46 projecting hot air onto the overlaps 38 and 39, respectively. This method of heat welding is also well known in the art and will not be further elaborated.

Step 60 consists of perforating the strip 32 of transparent polyethylene. For that purpose, an assembly of ball punches such as 47 is provided. The assembly of punches 47 is mounted oblique above the transparent strip 32 and is associated with a die 48 positioned under the strip 32. The die 48 comprises a plurality of holes such as 53, each cooperating with one of the punches 47 to produce the perforations 14. Ball punches of this type are described in U.S. Pat. No. 3,463,042 and are designed for continuous web operation. The perforations 14 are therefore produced in the strip 32 of transparent polyethylene as the band 43 travels.

Figure 2:
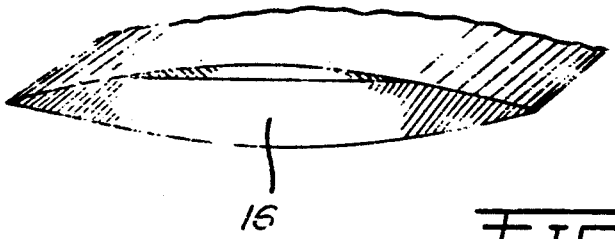
FIG. 2 is a perspective view of the closed end of the plastic bag of FIG. 1.

Another step 70 is designed to fold the single band 70 lengthwise in view of forming a band 49 comprising two layers of polyethylene material. As can be seen in FIG. 3, the single band 43 is folded about three generally centered longitudinal, parallel and adjacent lines in order to produce a two-layer band 49 comprising a two-fold edge 52 suitable to produce the two-fold closed end 16 of the bags 10 (FIGS. 1 and 2). An arrangement of rollers, guides, etc. (not shown) can be used to fold the band 43 and complete the step 70. This type of arrangement is again well known to those skilled in the art and accordingly will not be further described.

Step 80 is carried out by transversely cutting the two-layer band 49 at longitudinally spaced apart locations thereof while heat welding together the two layers of this band 49 on both sides of each cut. In the preferred embodiment, a heated movable blade 51, including an embedded electric heating element, is operated to perform simultaneously the transversal cutting and heat welding operations. Accordingly, each pair of consecutive cuts produces a plastic bag 10 comprising an open end 15, a closed two-fold end 16, and a transversal, perforated window 13 (see FIGS. 1 and 2).

Figure 3:
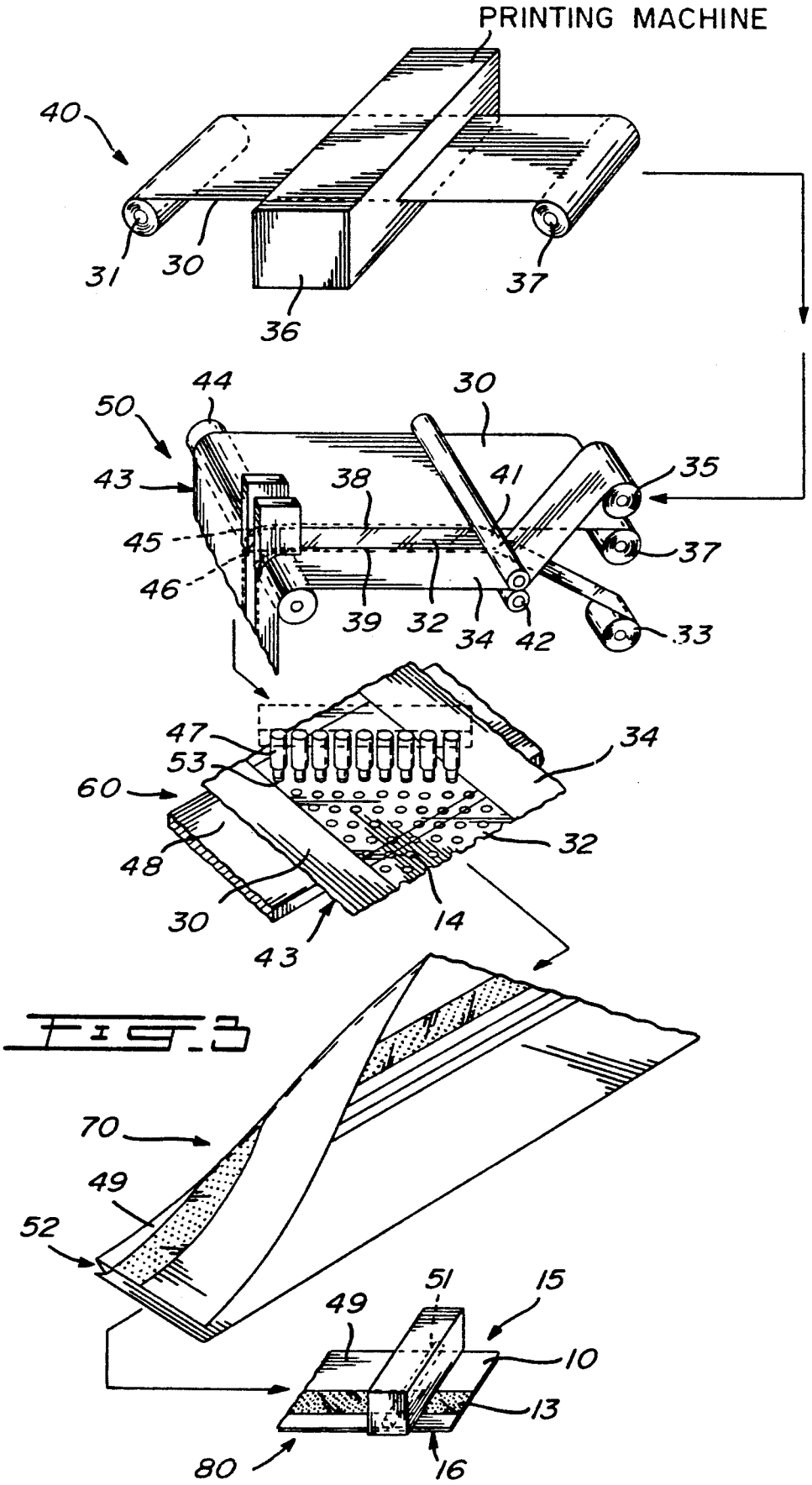
FIG. 3 is a schematic representation of a method and an apparatus for fabricating the plastic bag of FIGS. 1 and 2.

As can be appreciated by one skilled in the art, only one opaque strip of polyethylene can be used with the transparent strip to fabricate bags 10 in accordance with the method and apparatus illustrated in FIG. 3. The transparent window 13 would then be located at the upper portion of the rear wall 12 of the bag 10 of FIG. 1.

In the preferred embodiments, the bag 10 is made from three strips of polyethylene sheet. Of course, other plastic materials, including coextruded plastic films, can be used as long as they present similar characteristics: mechanical resistance, ability to be heat welded, opacity, etc.

It should finally be mentioned that the bag 10 in accordance with the present invention is fully recyclable.

Although the present invention has been described hereinabove by way of preferred embodiments thereof, such embodiments can be modified at will, within the scope of the appended claims, without departing from the spirit and nature of the subject invention.

The embodiments of the invention in which an exclusive property or privilege is claimed are defined as follows:

1. A bag for packaging fruits or vegetables, made of substantially opaque, flexible plastic sheet material and having a width as well as rear and front walls, wherein (a) at least one of said front and rear walls is formed with a transversal window made of transparent, flexible plastic sheet material, (b) the transversal window extends over the width of the bag and comprises perforations distributed over the surface of said window, and (c) the transparent plastic sheet material has a higher mechanical resistance than the substantially opaque plastic sheet material.

2. A bag as defined in claim 1, wherein the transparent plastic sheet material is thicker than the substantially opaque plastic sheet material.

3. A bag as defined in claim 1, wherein said transversal window is rectangular.

4. A bag as defined in claim 1, in which the transversal window is made of a strip of said transparent plastic sheet material joined to the substantially opaque plastic sheet material.

5. A bag as defined in claim 4, in which the strip of transparent plastic sheet material is heat welded to said substantially opaque plastic sheet material.

6. A bag as defined in claim 1, wherein said perforations are circular.

* * * * *

UNITED STATES PATENT AND TRADEMARK OFFICE

CERTIFICATE OF CORRECTION

PATENT NO. : 5,226,735

DATED : 13 July 1993

INVENTOR(S) : Beliveau

It is certified that error appears in the above-identified patent and that said Letters Patent is hereby corrected as shown below:

On the title page: Item [76] Inventors: delete "73 rue Masson, St-Roch de l'Achigan, Quebec, Canada" and insert --4455 Guenette, Chomedey, Laval, Quebec, CANADA, H7T 2H2--.

Signed and Sealed this

Twenty-second Day of March, 1994

*Attest:*

Bruce Lehman

BRUCE LEHMAN

*Attesting Officer*

*Commissioner of Patents and Trademarks*